US006056567A

United States Patent [19]

Schell

[11] Patent Number: 6,056,567

[45] Date of Patent: May 2, 2000

[54] INSERTION AND/OR EXTRACTION DEVICE FOR ELECTRONIC COMPONENT

[75] Inventor: Mark S. Schell, Palatine, Ill.

[73] Assignee: Berg Technology, Inc., Reno, Nev.

[21] Appl. No.: 09/158,370

[22] Filed: Sep. 22, 1998

[51] Int. Cl.[7] ..... H01R 13/62

[52] U.S. Cl. ..... 439/160

[58] Field of Search ..... 439/157, 152, 439/153, 155, 160, 327, 372; 29/829, 764, 762, 758, 741, 739

[56] References Cited

U.S. PATENT DOCUMENTS

| | | | |
|---|---|---|---|
| 3,952,232 | 4/1976 | Coules | 339/45 |
| 4,064,551 | 12/1977 | Lightfoot | 361/399 |
| 4,233,646 | 11/1980 | Leung et al. | 361/399 |
| 5,106,315 | 4/1992 | Billman et al. | 439/160 |
| 5,203,074 | 4/1993 | Lam | 29/829 |
| 5,367,761 | 11/1994 | Kabat et al. | 29/764 |
| 5,542,854 | 8/1996 | Owen | 439/157 |
| 5,584,705 | 12/1996 | Lin | 439/157 |
| 5,675,475 | 10/1997 | Mazura et al. | 361/798 |
| 5,676,561 | 10/1997 | Chiang | 439/328 |
| 5,746,613 | 5/1998 | Cheng et al. | 439/157 |
| 5,806,168 | 9/1998 | Wurst et al. | 29/566.4 |

*Primary Examiner*—Lincoln Donovan
*Assistant Examiner*—Chandrika Prasad
*Attorney, Agent, or Firm*—Brian J. Hamilla; M. Richard Page

[57] ABSTRACT

Disclosed is a memory insertion and extraction device for inserting a memory module into and removing a memory module from a circuit board connector. An insertion end of the device comprises two leverage arms with a pressure applicator disposed there between. An extraction end of the device comprises two pivot arms with a leverage applicator disposed there between. The insertion and extraction device is preferably manufactured from or coated with a non-conductive material.

16 Claims, 7 Drawing Sheets

INSERTION AND/OR EXTRACTION DEVICE FOR ELECTRONIC COMPONENT

FIELD OF THE INVENTION

The present invention relates generally to a device for inserting and removing electronic components such as memory modules from a printed circuit board.

BACKGROUND OF THE INVENTION

Computer memory is frequently mounted onto modular circuit boards or modules which can be inserted into a computer so as to expand the aggregate memory of the computer. Memory modules are connected to a main circuit board of a computer system through multi-pin edge connectors which reside on the main circuit board. Typically, an edge of the memory module is inserted into an edge connector so that the module is positioned perpendicular to the main circuit board. A number of memory modules can be closely positioned parallel to each other and perpendicular to the main circuit board. Such an arrangement conserves space on the main circuit board but results in a dense coupling of memory modules on the main circuit board.

Memory modules, particularly dual in-line memory modules (DIMM), can be quite large. Some DIMM's may be six inches long and have approximately 200 contacts. Normal insertion of a module into a connector is accomplished by forcing the edge of the memory module between opposing rows of metal contacts in the connector. Upwards of 20 pounds of force is sometimes required to properly seat a module in a connector. Further, the surface area on the module where force can be applied is very small. In some instances, the edge of the module where force may be applied is only 0.050 inches wide. Applying insertion pressure to hundreds of modules per day, such as is required in a computer assembly line, can become very uncomfortable for the person charged with such a task. Thus, there is a need in the art for a device which provides assistance in inserting memory modules into a connector.

It is known in the art to provide a memory module extraction device. For example, U.S. Pat. Nos. 5,203,074, 5,367,761, 5,106,315, and 3,952,232 disclose various purported memory module extraction devices. Each of these devices is specialized to work with a particular type of memory module and connector.

An alternative module and connector type for which an extraction device has not been designed employs a lever applied to an exterior edge of the module and connector. For such module and connector configurations, applying downward pressure to the lever causes the module to be unseated from the connector. However, it can sometimes be difficult to access the lever due to the relative little clearance that is often available between components connected to a circuit board. Thus, there is a need in the art for a memory extraction device for use with memory modules and connector pairs which employ a lever mechanism for extraction of the module.

Accordingly, a goal of the present invention is to provide an electronic component insertion and extraction device for assistance in inserting and removing electronic components from a printed circuit board connector.

SUMMARY OF THE INVENTION

An electronic component insertion and extraction device in accordance with the present invention addresses these and other shortcomings in the art. According to one aspect of the invention there is provided an insertion device for inserting a memory module into a circuit board connector. Typically, the memory module has a pressure area along at least one edge where pressure can be applied for seating the module in the connector. The connector may also have a base portion with leverage points positioned on its exterior. The insertion device comprises the following elements: an elongated handle having a first end and a second end; a first leverage arm extending from the first end of the handle, which first leverage arm has a first distal end positioned opposite the handle; a second leverage arm extending from the first end of the handle, the second leverage arm having a second distal end positioned opposite the handle and being displaced from the first leverage arm so as to form a channel between the first leverage arm and the second leverage arm; and a pressure applicator disposed in the channel between the first leverage arm and the second leverage arm. The pressure applicator is positioned away from the distal end of the first leverage arm and the distal end of the second leverage arm so that upon the first distal end and the second distal end being positioned against the leverage pressure points of the connector, the pressure applicator is positioned along the pressure area of the memory module. Movement of the second end of the device in a direction having both a horizontal and vertical components relative to the leverage points exerts downward pressure on the memory module and thereby causes the module to be seated in the connector. According to a preferred embodiment, the distal ends of the leverage arms have a hooked configuration. Further, the handle has grooves inserted therein for improved gripping of the device. Also the pressure applicator has a substantially curved surface for facilitating horizontal movement of the pressure applicator along the memory module. Where the connector has leverage points that are circular shaped trunnions, the hooked distal ends of the insertion device fit partially around the trunnions and provide a leverage point for application of an insertion force to the second end of the device.

According to another embodiment, the insertion device comprises the following items: a handle; at least one leverage arm extending from the handle, which leverage arm has a distal end remote from the handle; a pressure applicator disposed between the distal end and the handle for applying downward force on a memory module.

According to another aspect of the invention, there is disclosed an extraction device for removing a memory module from a connector. Typically, the connector has a lever disposed on at least one of the terminal ends of the connector so that application of a substantially downward force on the lever causes the memory module to be unseated from the connector. The connector might also have leverage points positioned on its exterior. The extraction device comprises the following items: an elongated handle having a first end and a second end; a first clearance arm extending from the second end of the handle; a second clearance arm extending from the second end of the elongated handle, which second clearance arm is displaced from the first clearance arm so as to form a channel between the first clearance arm and the second clearance arm; and a pressure applicator positioned substantially in the channel between the first clearance arm and the second clearance. When the pressure applicator is positioned upon the lever, the first and second clearance arms are positioned against the leverage points. Thereafter, if the first end of the handle is rotated downward relative to the leverage points, pressure is applied by the pressure applicator to the lever. The pressure displaces the lever and causes the memory module to be unseated from the connector. In a preferred embodiment, the first clearance arm and the second clearance arm have recesses formed therein. When the pressure applicator contacts the lever, the recesses are positioned substantially around the leverage points of the connector. In one embodiment, the recesses are formed at the distal ends of the clearance arms.

Other features of the present invention are described below.

BRIEF DESCRIPTION OF THE DRAWINGS

A full understanding of the invention can be gained from the following description of preferred embodiments when read in conjunction with the accompanying drawings in which.

DETAILED DESCRIPTION OF PREFERRED EMBODIMENTS

Figure 1A:
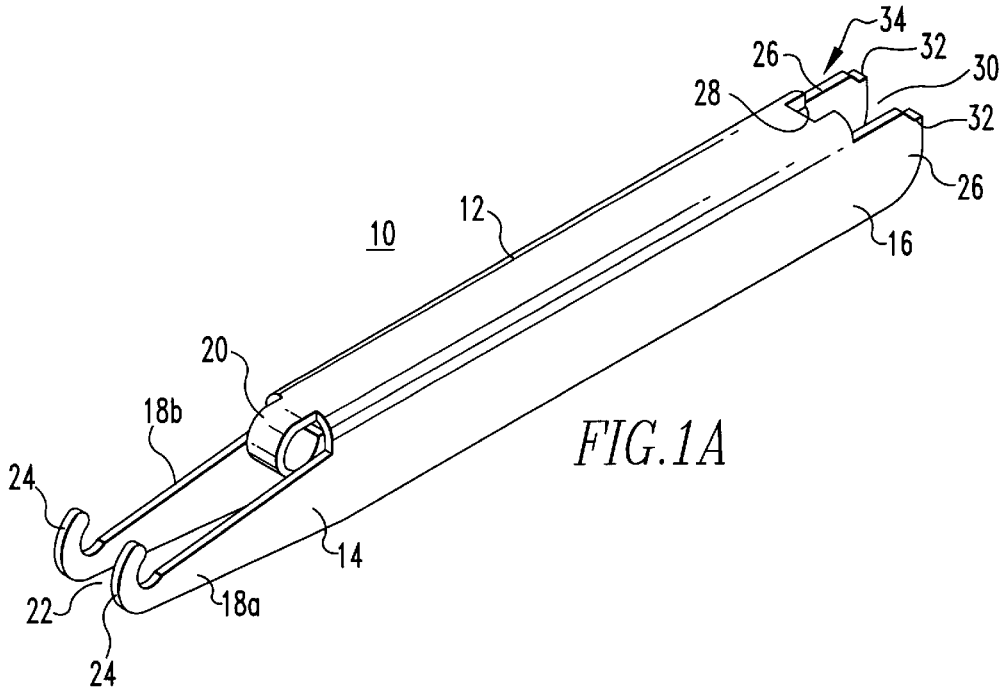
FIG. 1A provides a perspective view of an insertion/extraction device in accordance with the present invention.
Figure 1C:
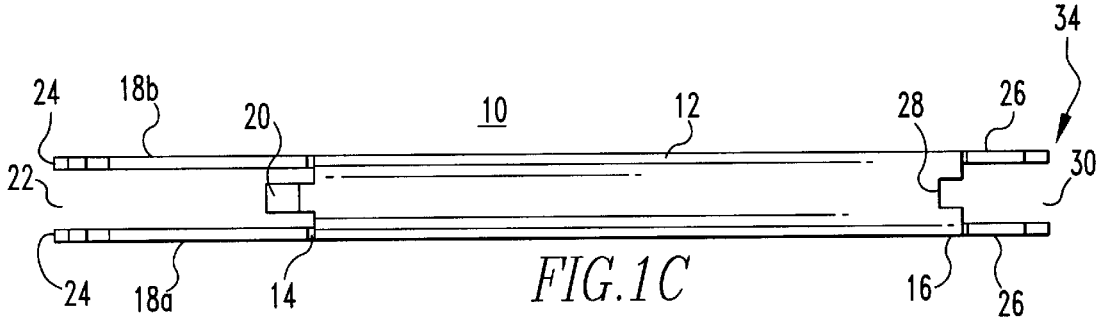
FIG. 1C provides a top view of the insertion/extraction device shown in FIG. 1A.
Figure 1B:
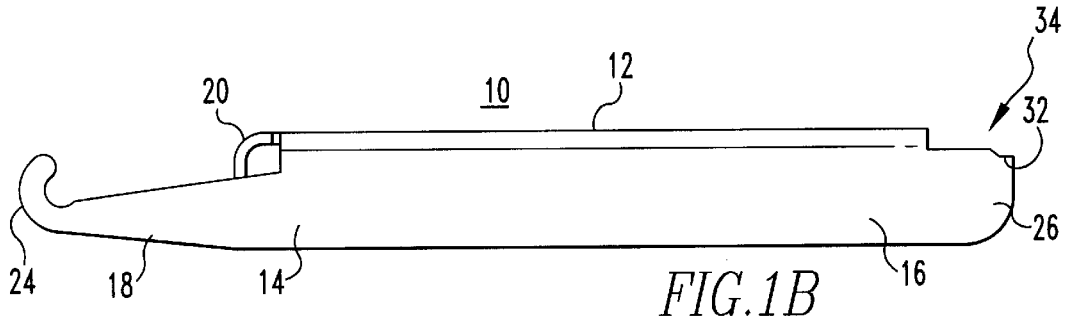
FIG. 1B provides a side view of the insertion/extraction device shown in FIG. 1A.
Figure 1D:
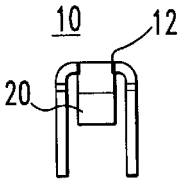
FIG. 1D provides a sectional view of the insertion/extraction device shown in FIG. 1A.

A memory module insertion device with the above-mentioned beneficial features in accordance with a presently preferred exemplary embodiment of the invention will be described below with reference to FIGS. 1 through 5. The description given herein with respect to those figures is for illustrative purposes only and is not intended in any way to limit the scope of the invention. Questions regarding the scope of the invention may be resolved by referring to the appended claims.

FIGS. 1A through 1D provide various views of inventive insertion/extraction device 10. As shown, insertion/extraction device 10 comprises an elongated handle 12 with a first end or insertion end 14 and a second end or extraction end 16. In a preferred embodiment, a first leverage arm 18*a* and a second leverage arm 18*b* extend from opposite sides of insertion end 14. A single leverage arm 18*a* may be employed in alternative embodiments. Pressure applicator 20 is disposed in channel 22 that is formed between leverage arms 18*a,* 18*b*. In a preferred embodiment, distal ends 24 of leverage arms 18*a,* 18*b* have a hook-like configuration.

A first pivot arm 26 and a second pivot arm 26 extend from opposite sides of extraction end 16 of device 10. In an alternative embodiment, a single pivot arm 26 may be employed. Notch 28 or extraction application surface is disposed in channel 30 that is formed between pivot arms 26. A pivot recess or notch 32 is formed at or near distal ends 34 of each pivot arm 26.

Figure 2A:
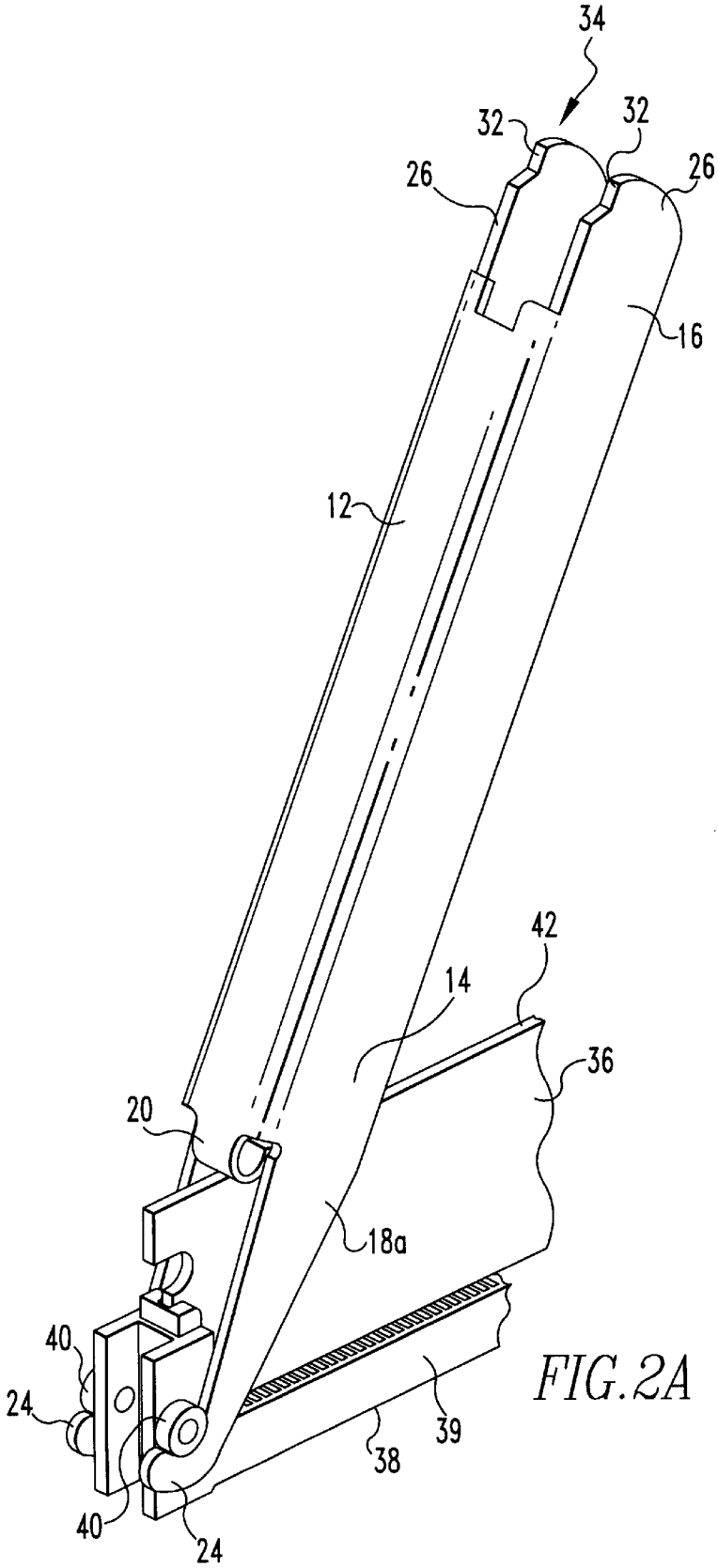
FIG. 2A is a perspective view of the insertion end of an insertion/extraction device in accordance with the present invention applied to a memory module and circuit board connector.
Figure 2B:
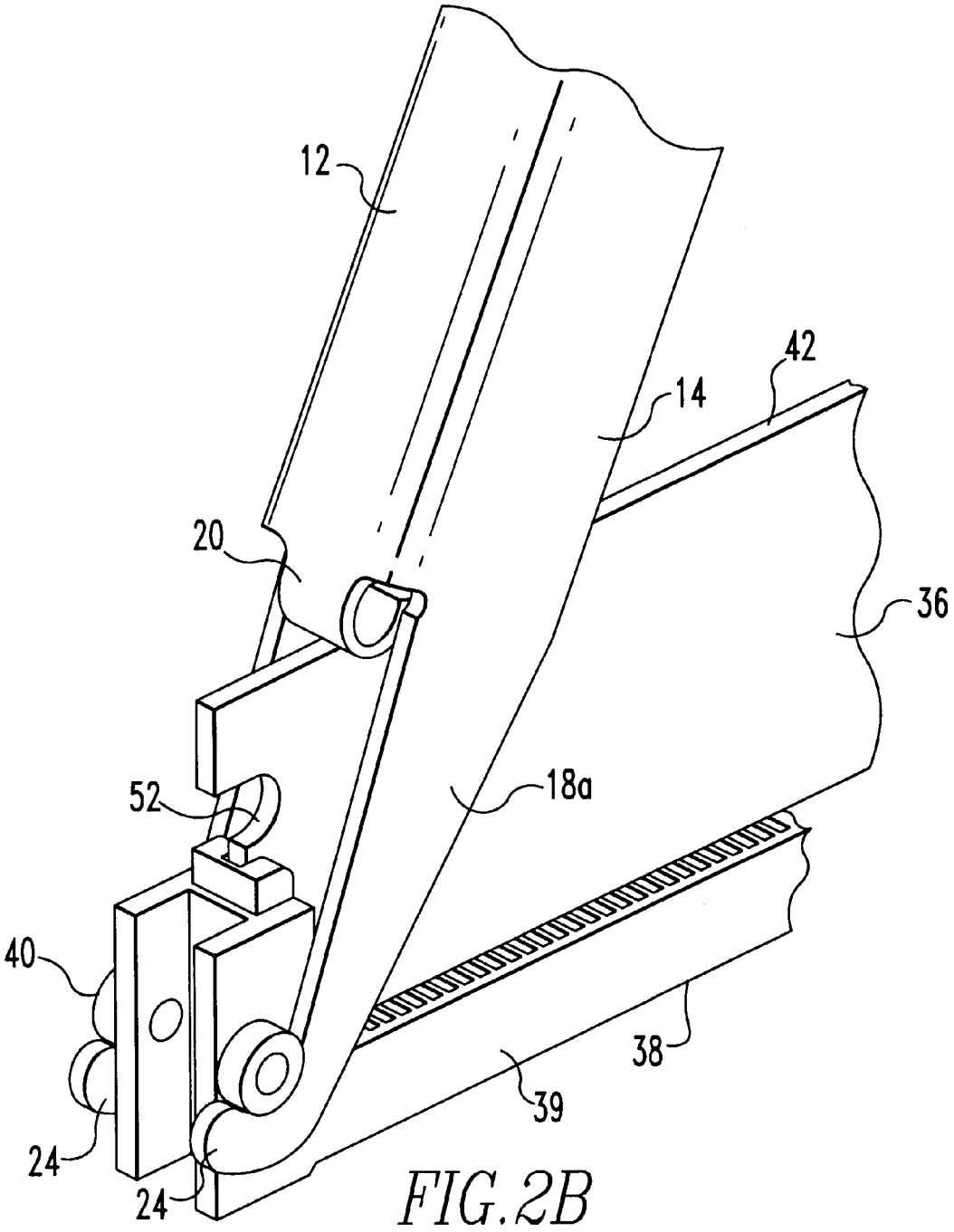
FIG. 2B is a detailed view of the insertion end of an insertion/extraction device in accordance with the present invention applied to a memory module and circuit board connector.

FIG. 2A provides a perspective view of insertion end 14 of inventive insertion/extraction device 10 applied to module 36 and module connector 38. FIG. 2B provides a detailed view of the interaction between device 10, electronic component 36 which may be a memory module and connector 38. As shown, module 36 has been situated above connector 38. Connector 38 comprises base 39 and leverage points 40. Leverage points or trunnions 40 are disposed along the exterior sides of connector 38 and provide leverage during the insertion and extraction process. Leverage arms 18*a,* 18*b* extend around memory module 36 with pressure applicator 20 coming to rest on pressure area or surface 42 of module 36. Hook distal ends 24 of leverage arms 18*a,* 18*b* are positioned against leverage points 40 and thereby provide leverage during the insertion process. In a preferred embodiment, pressure applicator 20 has a substantially rounded exterior which facilitates horizontal movement of pressure applicator 20 as module 36 is gradually inserted into connector 38. Handle 12 has grooves located therein to facilitate gripping device 10. Leverage recess 52 in module 36 is shaped to accept a lever and is used during the extraction of module 36. The extraction process is described below with reference to FIGS. 4A through 5B.

Figure 3A:
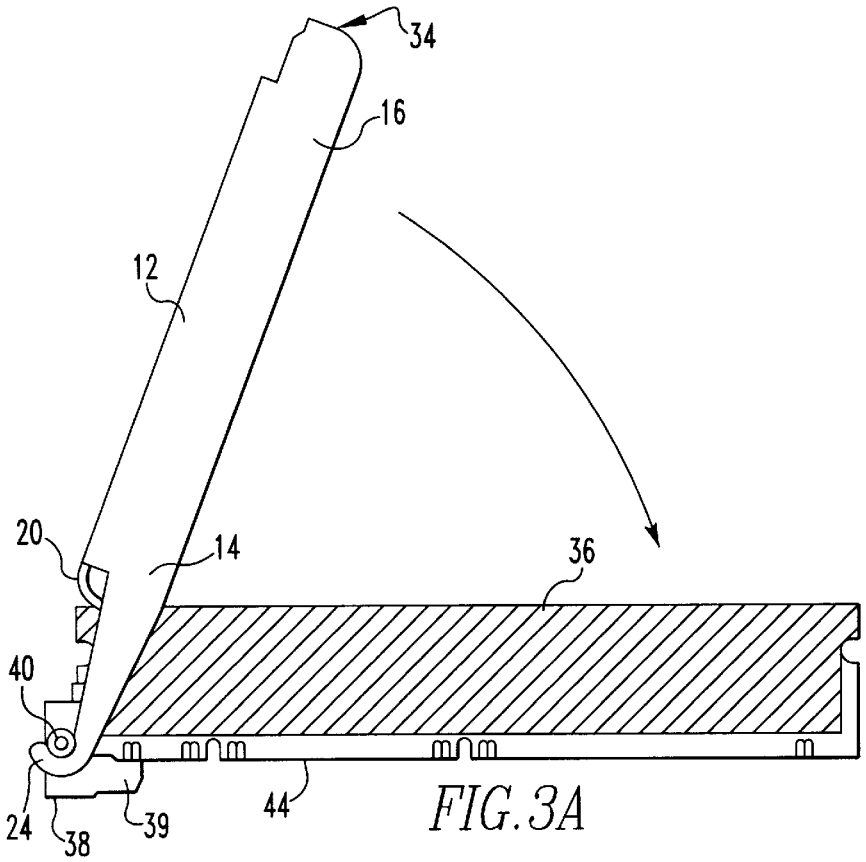
FIGS. 3A and 3B provide a perspective view of an insertion/extraction device in accordance with the present invention at various stages of the insertion process.
Figure 3B:
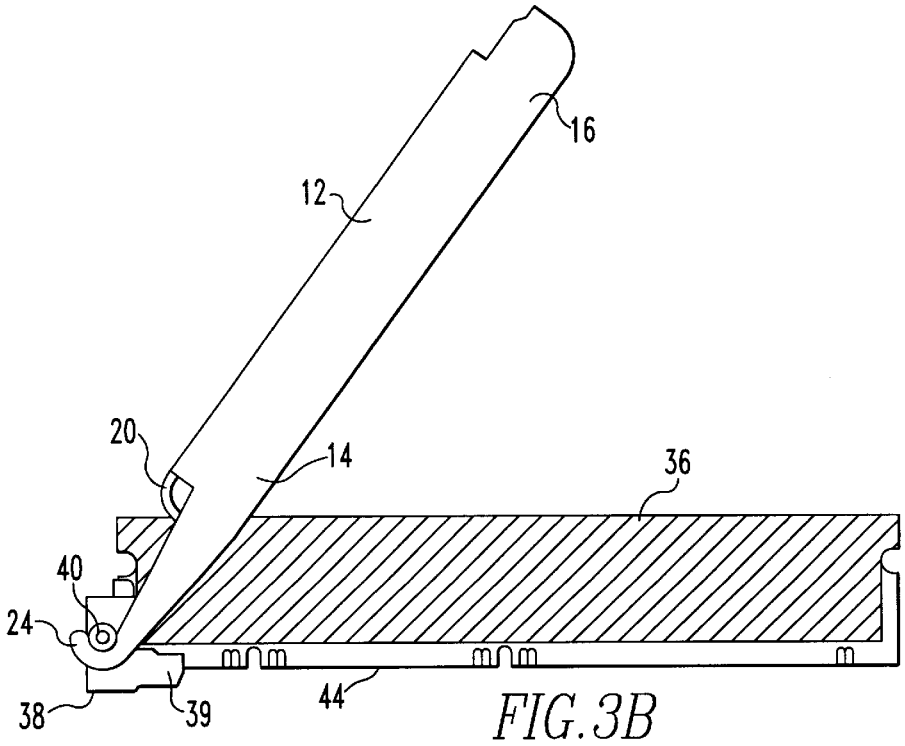

FIGS. 3A and 3B provide a perspective view of insertion/extraction device 10 and module 36 at various stages of the insertion process. With distal ends 24 positioned against leverage points 40, second end 16 of device 10 is rotated in a clockwise fashion relative to leverage points 40. As a result of this rotation, pressure applicator 20 exerts a downward force on surface 42 of module 36. The downward force causes module 36 to be gradually seated in connector 38. As module 36 is displaced into connector 38, pressure applicator 20 is free to move horizontally along the surface of module 36 away from leverage point 40. As pressure applicator 20 moves along surface 42, it exerts downward force on successive portions of module 36 and thereby gradually seats module 36 into connector 38.

It should be noted that in FIGS. 3A and 3B, a corner section only of connector 38 is shown, i.e. a portion of base 39 is not shown. In this way FIGS. 3A and 3B illustrate the movement of bottom edge 44 relative to base 39.

As shown in FIG. 3A, at the beginning of the insertion process, bottom edge 44 of module 36 is not seated in connector 38 and pressure applicator 20 is located near the terminal end of module 36. Gradually, second end 16 of insertion/extraction device 10 is displaced clockwise relative to said leverage point 40 to arrive in a position shown in FIG. 3B. As shown in FIG. 3B, bottom edge 44 of module 36 has been displaced downward relative to base 39 so as to become seated in connector 38 and pressure applicator 20 has been displaced sideways away from the terminal end of the module 36.

Generally, due to the large size of some modules, the process of seating a module using an insertion device in accordance with the present invention requires applying device 10 to the opposite end of module 36 and connector 38 opposite that shown in FIGS. 3A and 3B. When insertion/extraction device is applied to this opposite end, second end 16 of device 10 is rotated in a counterclockwise (i.e. opposite the direction illustrated in FIGS. 3A and 3B) fashion to seat the remaining portion of module 36 into connector 38.

Figure 4A:
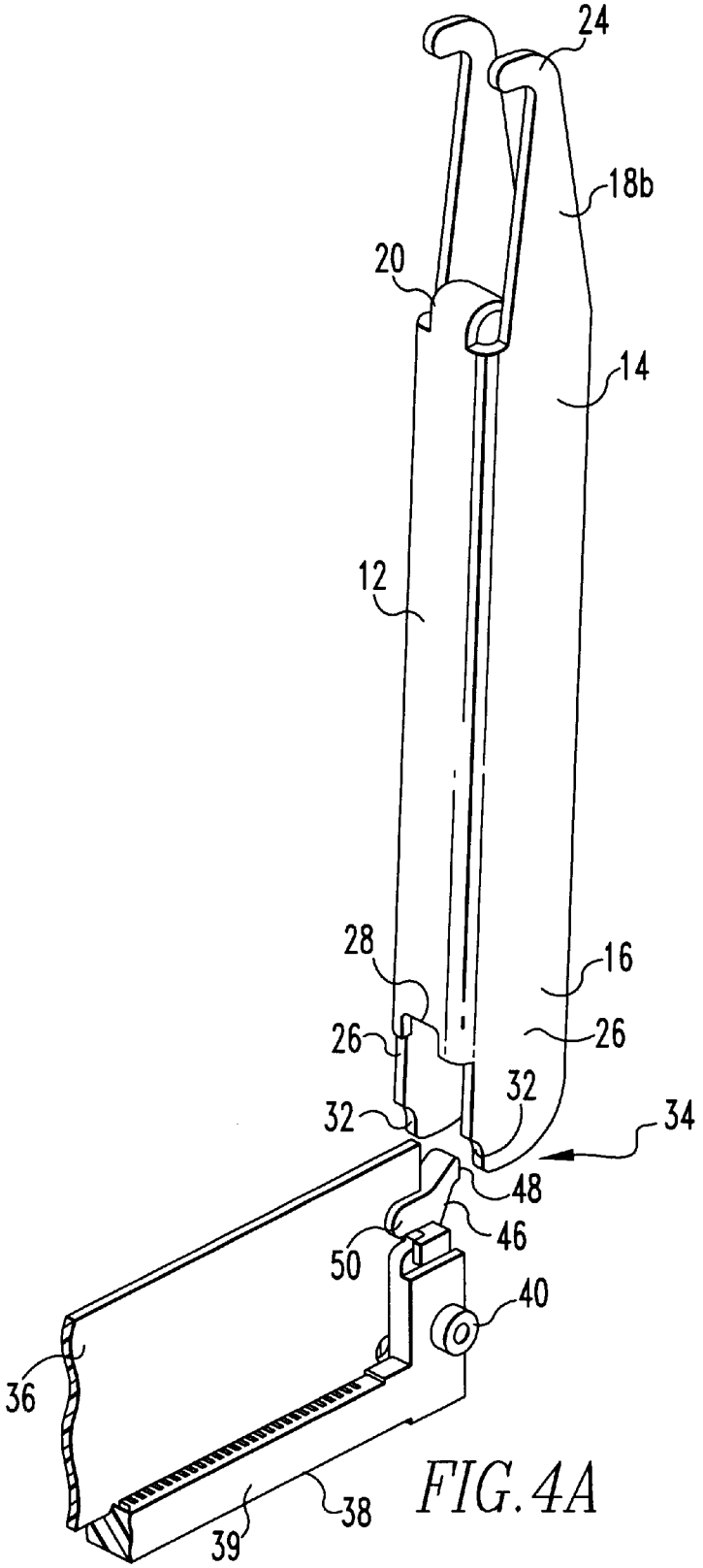
FIG. 4A provides a view of the extraction end of an insertion/extraction device in accordance with the present invention applied to a memory module and circuit board connector.
Figure 4B:
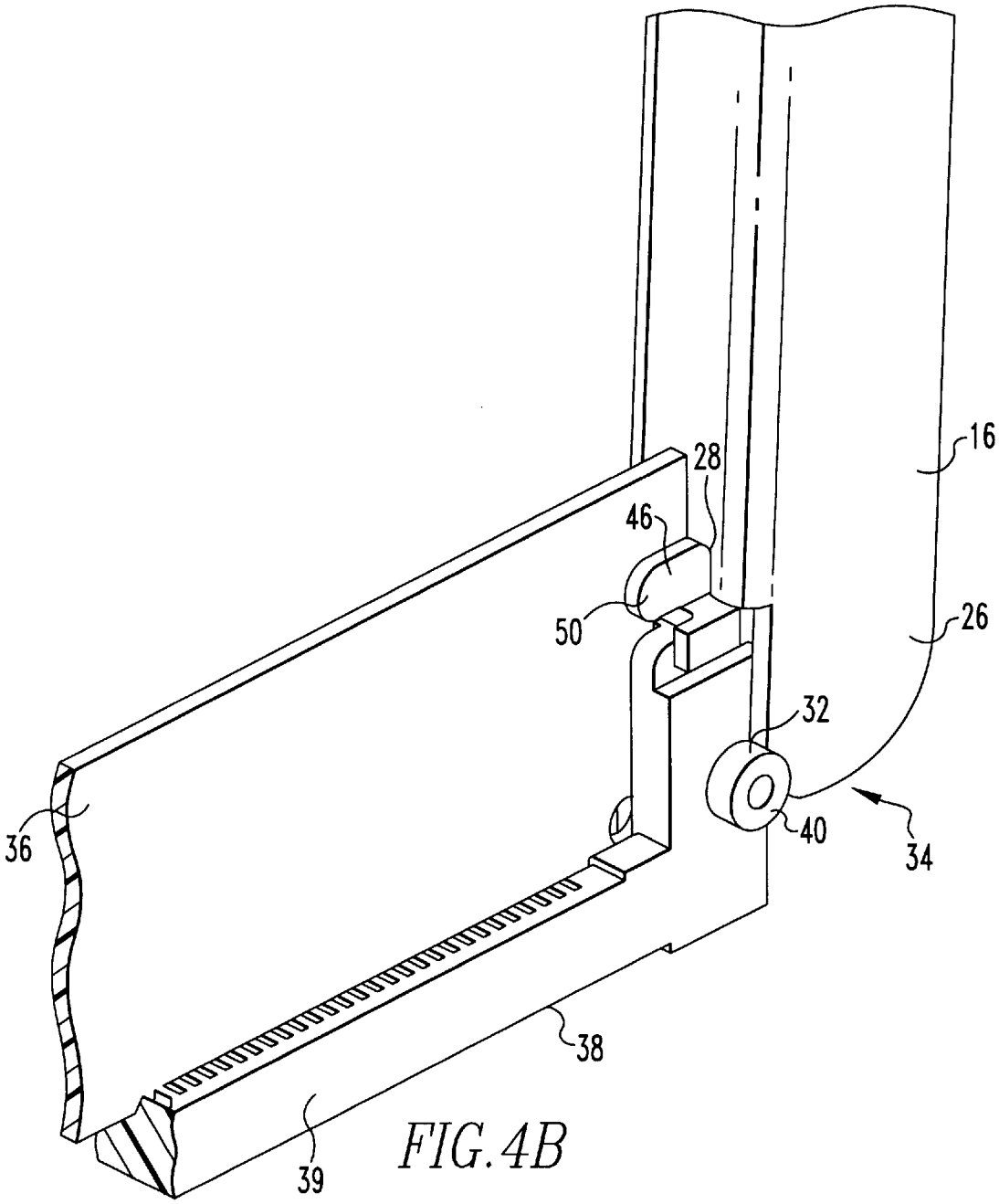
FIG. 4B provides a detailed view of the extraction end of an insertion/extraction device in accordance with the present invention applied to a memory module and circuit board connector.

FIG. 4A provides a view of extraction end 16 of device 10 prior to application to connector 38 and module 36. A lever 46 is positioned or situated substantially on connector 38. A first lever arm 48 of lever 46 is positioned away from module 36. A second lever arm 50 of lever 46 is located substantially within recess 52 of module 36 which was previously described above with reference to FIG. 2B. Notch 28 disposed between first and second pivot arms 26 is designed to engage first lever arm 48 of lever 46. Pivot recesses or notches 32 at distal ends 34 of pivot arms 26 are formed to engage leverage points 40 on the exterior of connector 38. FIG. 4B provides a view of extraction end 16 of device 10 seated on lever 46 and connector 38. As shown, recesses 32 are situated around leverage points 40 while notch 28 is positioned over first lever arm 48 of lever 46.

Figure 5A:
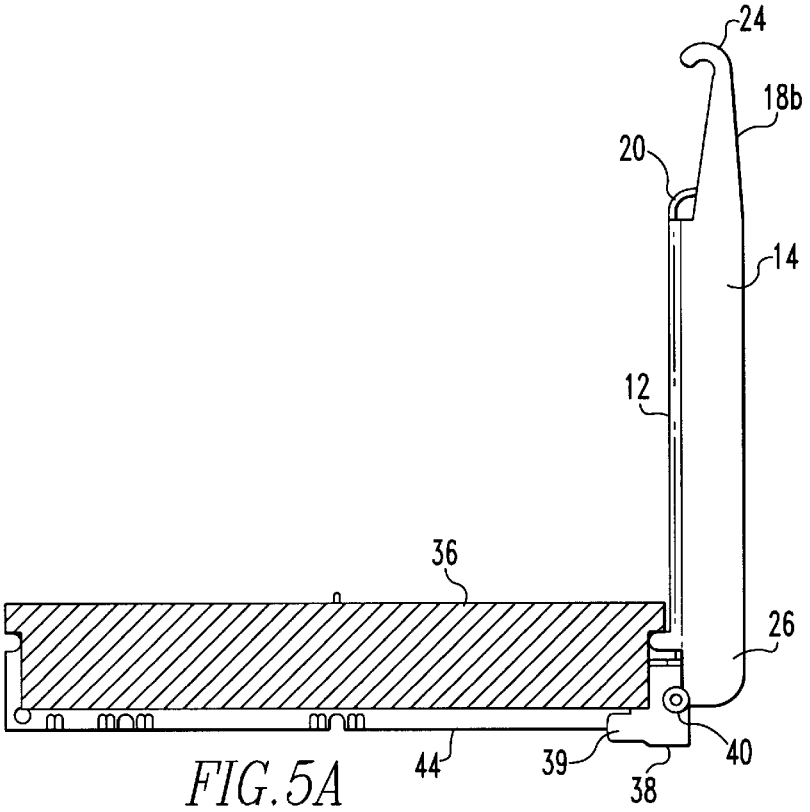
FIGS. 5A and 5B provide perspective views of the extraction end of an insertion/extraction device in accordance with the present invention at various stages of the extraction process.
Figure 5B:
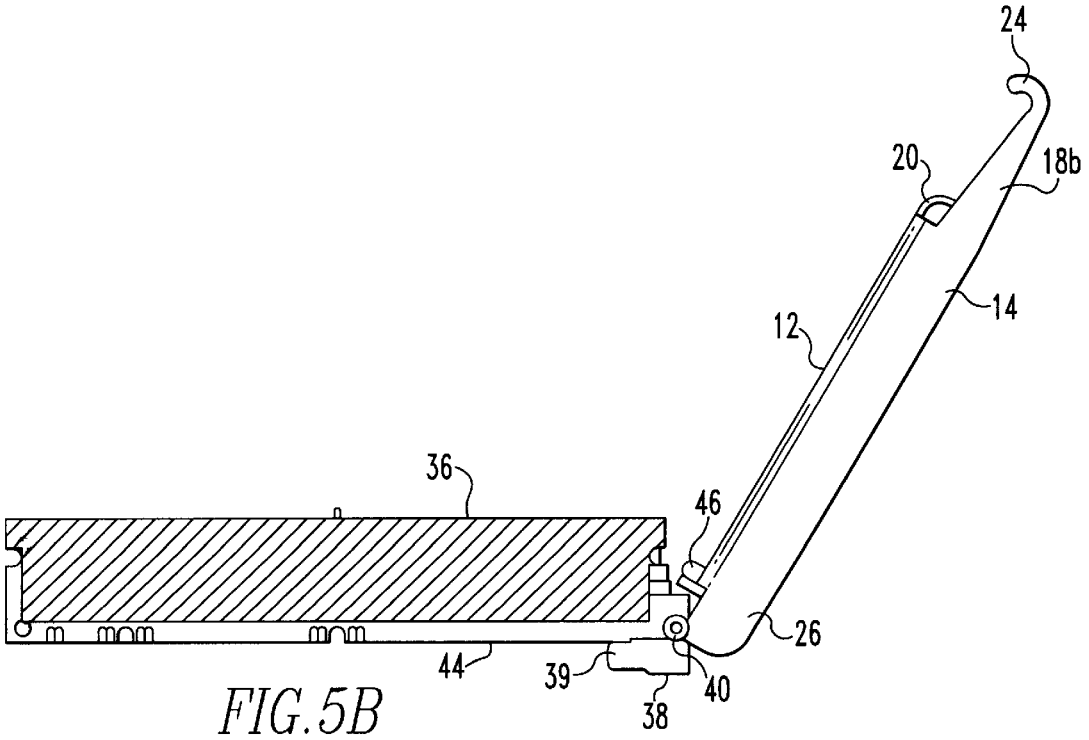

FIGS. 5A and 5B provide a perspective view of the extraction end 16 and module 36 at various stages of the extraction process. It should be noted that in FIGS. 5A and 5B, a corner section only of connector 38 is shown, i.e. a portion of base 39 is not shown. In this way FIGS. 5A and 5B illustrate the movement of bottom edge 44 relative to base 39. As shown in FIG. 5A, at the start of the extraction process, module 36 is seated in connector 38. Handle 12 of insertion/extraction device is substantially perpendicular to module 36 and connector 38. In order to unseat module 36 from connector 38, insertion end 14 of device 10 is rotated clockwise relative to leverage points 40. As insertion end 14 rotates, notch 28 applies a force in a clockwise direction to first lever arm 48 of lever 46. The clockwise motion of first lever arm 48 of lever 46 causes second lever arm 50 to exert an upward force on module 36 at lever recess 52. The upward force is sufficient to unseat a portion of module 36 from connector 38. FIG. 5B provides a view of the insertion/extraction device 10 rotated clockwise from the position shown in FIG. 5A. As shown, bottom edge 44 of module 36 has been lifted relative to connector 38. Thus, the rotation of device 10 has caused a first end of module 36 to be unseated from connector 38. Extraction end 16 of device 10 can be positioned at the end of module 36 and connector 38 opposite that shown in FIGS. 5A and 5B so as to similarly unseat the opposite end of module 36.

The present invention may be employed in other specific forms without departing from the spirit or essential attributes thereof. For example, either the insertion end or extraction end of the device described above can be manufactured as a separate device from the other. Also, according to one embodiment, a single leverage arm may extend from the insertion end of the device. Likewise, a single pivot arm may extend from the extraction end of the device. Of course, in still other embodiments, more than two leverage arms or pivot arms may extend from ends of the device. Accordingly, the scope of protection of the following claims is not limited to the presently preferred embodiment disclosed above.

I claim:

1. An insertion device for inserting an electronic component into a connector, said electronic component having a pressure area along at least one peripheral edge where pressure can be applied for seating the electronic component in the connector, the connector having a base with leverage points positioned on its exterior, comprising:

an elongated handle having a first end and a second end;

a first leverage arm extending from said first end of said handle, said first leverage arm having a distal end positioned opposite said handle;

a second leverage arm extending from said first end of said handle, said second leverage arm having a distal end positioned opposite said handle and said second leverage arm being displaced from said first leverage arm so as to form a channel between said first leverage arm and said second leverage arm; and a pressure applicator disposed in said channel between said first leverage arm and said second leverage arm, said pressure applicator positioned away from said distal end of said first leverage arm and said distal end of said second leverage arm so that upon said distal ends being positioned against the leverage points of the connector, said pressure applicator is positioned along the pressure area of the electronic component and movement of said second end of said device relative to the leverage points exerts an insertion pressure on the electronic component and thereby causes the electronic component to be seated in the connector.

2. The insertion device of claim 1 wherein said distal ends have a hooked configuration.

3. The insertion device of claim 1 wherein said handle has grooves therein for improved gripping of said device.

4. The insertion device of claim 1 wherein said pressure applicator has a substantially curved surface for facilitating horizontal movement of said pressure applicator along the memory module.

5. The insertion device of claim 2 for use with a connector having leverage points that are circular shaped trunnions, wherein said hooked distal ends of said insertion device fit partially around said trunnions, said trunnions providing a leverage point for application of force to said second end of said device.

6. A hand tool for inserting electronic components into connectors, comprising:

a handle;

at least one leverage arm extending from said handle, said at least one leverage arm having a distal end remote from said handle; and a pressure applicator disposed between said distal end and said handle, said pressure applicator being removably applied to an electronic component for applying an insertion force on said electronic component.

7. An extraction device to assist removing an electronic component from a connector, the connector having a lever disposed on at least one of the terminal ends of the connector so that application of a force on the lever causes the electronic component to be unseated from the connector, the connector having leverage points positioned on its exterior, comprising:

an elongated handle having a first end and a second end;

a first pivot arm extending from said second end of said handle;

a second pivot arm extending from said second end of said elongated handle, said second pivot arm being displaced from said first pivot arm so as to form a channel between said first pivot arm and said second pivot arm; and a pressure applicator positioned substantially in said channel between said first pivot arm and said second pivot arm whereby when said pressure applicator is positioned upon the lever, said first and said second pivot arms positioned against the leverage points, and said first end of said handle rotated relative to the leverage points, pressure is applied by said pressure applicator to the lever, displacing the lever and causing the electronic component to be unseated from the connector.

8. The extraction device of claim 7, wherein said first pivot arm and said second pivot arm have pivot recesses formed therein, said pressure applicator contacting the lever when said pivot recesses engage the leverage points of the connector so that when said first arm of said extraction device is pivoted around said leverage point, the lever is displaced and the electronic component unseated from the connector.

9. The extraction device of claim 8, wherein said pivot recesses are formed at the distal ends of said first and said second pivot arms.

10. A system for connecting an electronic component to a circuit substrate, wherein said electronic component has a pressure area along at least one peripheral edge where pressure can be applied, said system comprising:

a connector adapted to be mounted to said circuit substrate, said connector comprising leverage points positioned on its exterior; and an insertion tool, comprising:

an elongated handle having a first end and a second end;

a first pivot arm extending from said first end of said handle, said first pivot arm having a first distal end positioned opposite said handle;

a second pivot arm extending from said first end of said handle, said second pivot arm having a second distal end positioned opposite said handle and said second pivot arm being displaced from said first pivot arm so as to form a channel between said first pivot arm and said second pivot arm; and a pressure applicator disposed in said channel between said first pivot arm and said second pivot arm, said pressure applicator positioned away from said distal end of said first pivot arm and said distal end of said second pivot arm so that upon said first distal end and said second distal end being positioned against the leverage points of the connector, said pressure applicator is positioned along the pressure area of the electronic component and movement of said second end of said insertion tool relative to the leverage points exerts pressure on the electronic component and thereby causes the electronic component to be seated in the connector.

11. A card edge connector for use with at least one of an insertion device and an extraction device, comprising:

a base having at least one leverage point positioned on its exterior, said at least one leverage point for providing leverage to the at least one of the insertion device and the extraction device during one of insertion of an electronic component and extraction of a electronic component from said connector.

12. The electrical connector of claim 11 wherein said at least one leverage point is a circular shaped trunnion.

13. The card edge connector of claim 11 wherein the insertion device is an insertion and extraction device and said card edge connector further comprises:

a lever on said base, said lever adapted to apply an extraction force on said electronic component, said extraction device engaging said leverage point and said lever to assist said lever in extracting said electronic component from said connector.

14. A system for removing an electronic component from a circuit substrate, comprising:

a connector adapted to be mounted to said circuit substrate, said connector comprising a base, leverage points positioned on said base;

a lever positioned substantially on said base; and an extraction tool, comprising:

an elongated handle having a first end and a second end;

a first pivot arm extending from said second end of said handle;

a second pivot arm extending from said second end of said elongated handle, said second pivot arm being displaced from said first pivot arm so as to form a channel between said first pivot arm and said second pivot arm; and a pressure applicator positioned substantially in said channel between said first pivot arm and said second pivot arm whereby when said pressure applicator is positioned upon said lever, said first and said second pivot arms positioned against said leverage points, and said first end of said handle rotated relative to the leverage points, pressure is applied by said pressure applicator to said lever and transferred to the electronic component, causing the electronic component to be unseated from the connector.

15. An insertion and extraction device for use in inserting an electronic component into a connector and removing an electronic component from a connector, said electronic component having a pressure area along at least one peripheral edge where pressure can be applied for seating the electronic component in the connector, comprising:

a handle;

at least one leverage arm extending from said handle and having a distal end remote from said handle;

a first pressure applicator extending from said handle, said first pressure applicator for applying an insertion force to the pressure area of the electronic component during insertion of the electronic component into the connector;

at least one pivot arm extending from said handle and having a distal end remote from said handle; and a second pressure applicator extending from said handle, said second pressure applicator for supplying an extraction force to the electronic component during extraction of the electronic component from the connector.

16. The insertion device as recited in claim 1, wherein said pressure applicator engages an edge of said electronic component located furthest from said connector.

* * * * *